US005141215A

United States Patent [19]

Ishiguro et al.

[11] Patent Number: 5,141,215

[45] Date of Patent: Aug. 25, 1992

[54] SORTER-FINISHER PROVIDED FOR AN IMAGE FORMING APPARATUS

[75] Inventors: Kuniaki Ishiguro; Takuma Ishikawa; Toshio Matsui, all of Osaka, Japan

[73] Assignee: Minolta Camera Kabushiki Kaisha, Osaka, Japan

[21] Appl. No.: 394,626

[22] Filed: Aug. 16, 1989

[30] Foreign Application Priority Data

| | | | |
|---|---|---|---|
| Aug. 27, 1988 | [JP] | Japan | 63-213473 |
| Aug. 27, 1988 | [JP] | Japan | 63-213474 |
| Aug. 27, 1988 | [JP] | Japan | 63-213475 |
| Aug. 27, 1988 | [JP] | Japan | 63-213476 |

[51] Int. Cl.[5] ..... B42B 2/00

[52] U.S. Cl. ..... 270/53; 270/52; 271/287; 271/294

[58] Field of Search ..... 270/37, 53, 58; 271/287, 292, 294

[56] References Cited

U.S. PATENT DOCUMENTS

| | | | |
|---|---|---|---|
| 3,995,748 | 12/1976 | Looney | 270/53 |
| 4,248,525 | 2/1981 | Sterrett . | |
| 4,361,393 | 11/1982 | Noto . | |
| 4,411,515 | 10/1983 | Kukucka et al. . | |
| 4,811,048 | 3/1989 | Ishikawa et al. . | |

FOREIGN PATENT DOCUMENTS

| | | | |
|---|---|---|---|
| 63-267661 | 11/1988 | Japan | 270/58 |

*Primary Examiner*—Edward K. Look
*Assistant Examiner*—Therese M. Newholm
*Attorney, Agent, or Firm*—Burns, Doane, Swecker & Mathis

[57] ABSTRACT

A sorter-finisher wherein sheets discharged from an image forming apparatus are distributed among a plurality of bins in a sorter unit, and thereafter the sheets are taken out of each bin and transported to a finisher unit to be finished. The bins are put one upon another, and they are movable up and down. A take-out unit for taking sheets out of each bin in order to transport the sheets to the finisher unit is installed above the bins positioned for the distributing operation. Each bin is moved up to the position facing the take-out unit and further is laterally moved toward the take-out unit, and the sheets in the bin are taken out thereof nipped by a pair of rollers. Further, the sorter-finisher comprises a transporting unit which is a route from the discharge portion of the image forming apparatus to a receiving-/take-out portion of the sorter unit, and sheets are transported to the bins and also transported to the finisher unit through the transporting unit.

10 Claims, 15 Drawing Sheets 100
105
130
101
102
X1
X2
A
120
110
211
210
200
201
202
204
205
70
65
64
62
61
50
53
55
59
31
32
30
34
36
35
29
4
SE1
22
26
21
20
25
10
11
b
3
8
7
6
2
5
19
1

SORTER-FINISHER PROVIDED FOR AN IMAGE FORMING APPARATUS

BACKGROUND OF THE INVENTION

1. Field of the Invention

The present invention relates to a sorter-finisher, specifically, a sorter-finisher wherein sheets discharged from an image forming apparatus such as an electrophotographic copying machine are distributed among a plurality of bins equipped for a sorter unit, and thereafter the sheets are taken out thereof and transported to a finisher unit to be subjected to finishing operation such as stapling operation.

2. Description of Related Art

Recently, responding to the increasing demand for automatic paper handling systems for copying machines, and a sorting system for sorting and grouping copied sheets have been developed and commercialized in various types. The users of the copying machines are requiring a sorter-finisher capable of automatically binding and stacking sheet which have been distributed in the sorting system, and this type of sorter-finisher has been already commercialized for some of large-sized copying machine.

When combining a finisher with a sorter, a paper take-out position where sheets stored in each bin are taken out thereof should be iinstalled, In providing a finisher for a sorter which has a plurality of bins arranged one upon another, suppose that the paper take-out position is arranged under the bins. In this type of sorter-finisher, when more bins are demand, the additional bins have to be put above the formers, thereby making the whole apparatus larger. Further, the size of the finisher unit depends on the maximum sheet size which can be subjected to the finishing operation. When the paper take-out position is arranged under the bins, the finisher unit should be arranged under the bins, too. Accordingly, the arrangement makes the whole apparatus larger.

Also, when providing a finisher for a sorter which has a plurality of bins arranged one upon another, in order to take sheets out of the bins; conventionally, a pair of nippers or a pair of rollers equipped for an arm at the end enters each bin to nip sheets therein at the edge. In this case, in order to prevent the pair of rollers or nippers from coming into contact with the upper and the lower bins, the intervals among the bins should be widened. Accordingly, a cam with a spiral groove whose pitch is partly wide is in general use, and the intervals among the bins are widened in response to the rotation of the cam according to the step of the paper take-out operation. However, it costs a lot to make a spiral cam.

An apparatus wherein a pair of rollers provided for an arm at the end enters each bin to nip sheets in the bin at the end portion and take tha sheets out thereof is disclosed by U.S. Pat. No. 4,811,048. However, it is not enough to just nip sheets at the end portion by a pair of rollers. When the end portion of the sheets is curled, the pair of rollers may push the sheets on the bin to reverse, resulting in a failure in nipping.

In another point, when a finisher is provided for a sorter, two paper paths, one of which leads paper from an image forming apparatus to a sorter, and the other of which leads paper from the sorter to a finisher, are necessary. As a result, here comes the problem that the whole apparatus becomes larger.

SUMMARY OF THE INVENTION

It is, therefore, an object of the present invention to provide a sorter-finisher wherein a finisher unit can be installed effectively in point of space, and accordingly the whole apparatus becomes compact.

Another object of the present invention is to provide a sorter-finisher comprising paper take-out means which has a simple constitution.

Another object of the present invention is to provide a sorter-finisher wherin sheets in each bin are certainly taken out thereof by a pair of take-out rollers.

Another object of the present invention is, further, to provide a sorter-finisher which is effective in point of space by making a paper path common to a plurality of routes.

In order to attain the above mentioned objects, in a sorter-finisher according to the present invention, take-out means for taking sheets out of each bin is installed above the bins positioned for distributing operation. Sheets discharged from an image forming apparatus are distributed among the bins, and during this distributing operation, the bins are set under the take-out means. This position of the bins is a waiting position, and a number of bins stand by at the lower part in a compact state. After the distributing operation, the bins are moved up the position facing the take-out means, and the sheets are taken out of the bins. The sheets taken out of each bin are transported to a finisher unit. The finisher unit is arranged below the take-out means, beside the bins, contributing to effective usage of space. The take-out means comprises, for example, a pair of rollers for nipping sheets at the end portion in each bin moved up to the paper take-out position.

Further, a sorter-finisher according to the present invention comprises first drive means for vertically moving a plurality of bins arranged one upon another and second drive means for laterally moving each bin brought almost to the take-out position by the first drive means toward the take-out means. After sheets discharged from an image forming apparatus are distributed among the bins, each bin is moved vertically by the first drive means and laterally by the second drive means toward the take-out means. That is, the bin set at the take-out position protrudes the edge compared with the other bins, and sheets in the protruded bin are taken out thereof by the take-out means. Accordingly, the intervals among bins need not be widened for the paper take-out operation, so that an expensive spiral cam is not necessary.

A sorter-finisher according to the present invention, further, comprises a first take-out roller which comes into contact with a surface of the sheets stored in each bin immediately before the bin reaches the take-out position, and moves following the movement of the bin, keeping in touch with the sheets, and a second take-out roller which, after the first take-out roller come into contact with the surface of the sheets, comes into contact with the other surface of the sheets to nip the sheets in cooperation with the first take-out roller. With this arrangement, immediately before each bin reaches the take-out position, first a surface of sheets in the bin comes into contact with the first take-out roller, so that the sheets are pushed down by the first take-out roller. Thereafter, the second take-out rollers comes into contact with the other surface of the sheets, and the sheets are nipped between the two rollers. Therefore, even if the end portion of the sheets is curled, the sheets are certainly nipped and taken out of the bin. The nipped sheets can be taken out of the bin by rotating at least one of the first and second take-out rollers, and transported to the finisher unit.

Furthermore, a sorter-finisher according to the present invention comprises a paper transporting unit for connecting a paper discharge portion of an image forming apparatus and a paper receiving/take-out portion of the sorter unit, and the transporting unit has diverting means for diverting the travel of sheets to make a route from the discharge portion of the image forming apparatus to the sorter unit or to make a route from the sorter unit to the finisher unit. Sheets discharged from the image forming apparatus are transported to the sorter unit through the transporting unit and distributed among the bins. On the other hand, sheets distributed among the bins are taken out thereof through almost the same place where the sheets were received by the sorter unit, and the sheets are transported to the finisher unit through the transporting unit. In the transporting unit, the direction of the sheets is designated by the control of the diverting means. With the above-described arrangement, the transporting unit is commonly used as a route to the sorter unit and a route to the finisher unit, omitting waste of space and resulting in a sorter-finisher with a simple constitution.

BRIEF DESCRIPTION OF THE DRAWINGS

These and other objects and features of the present invention will become apparent from the following description taken in conjunction with the preferred embodiments thereof with reference to the accompanying drawings.

FIG. 1 is a schematic view showing a general constitution of a copying machine provided with a sorter-finisher;

Figure 3:
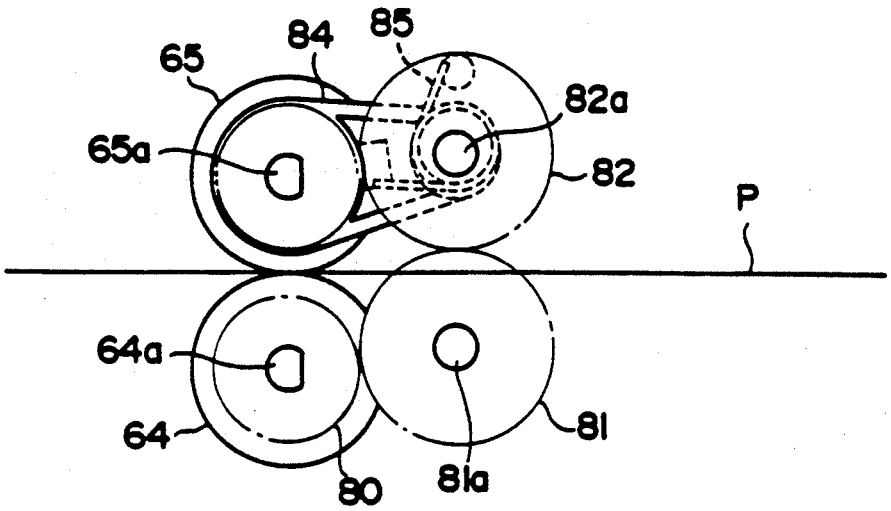
Figure 4:
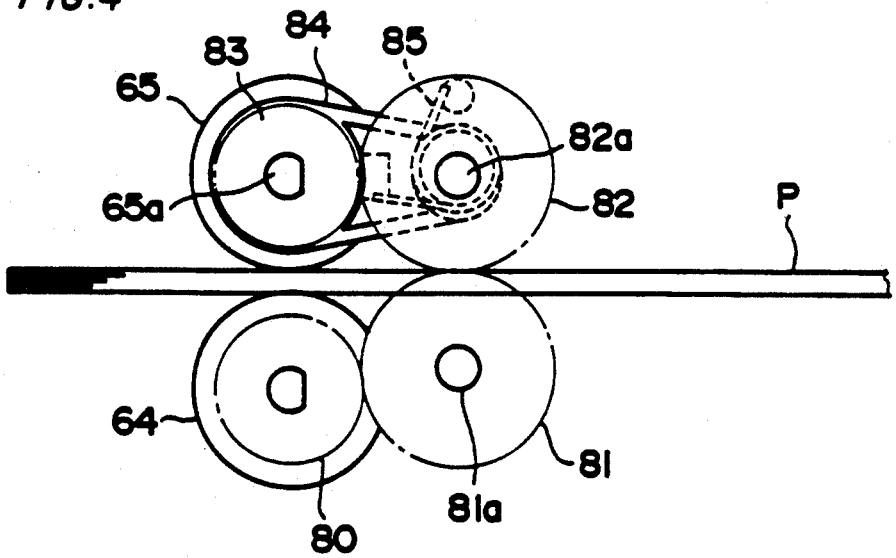
Figure 5:
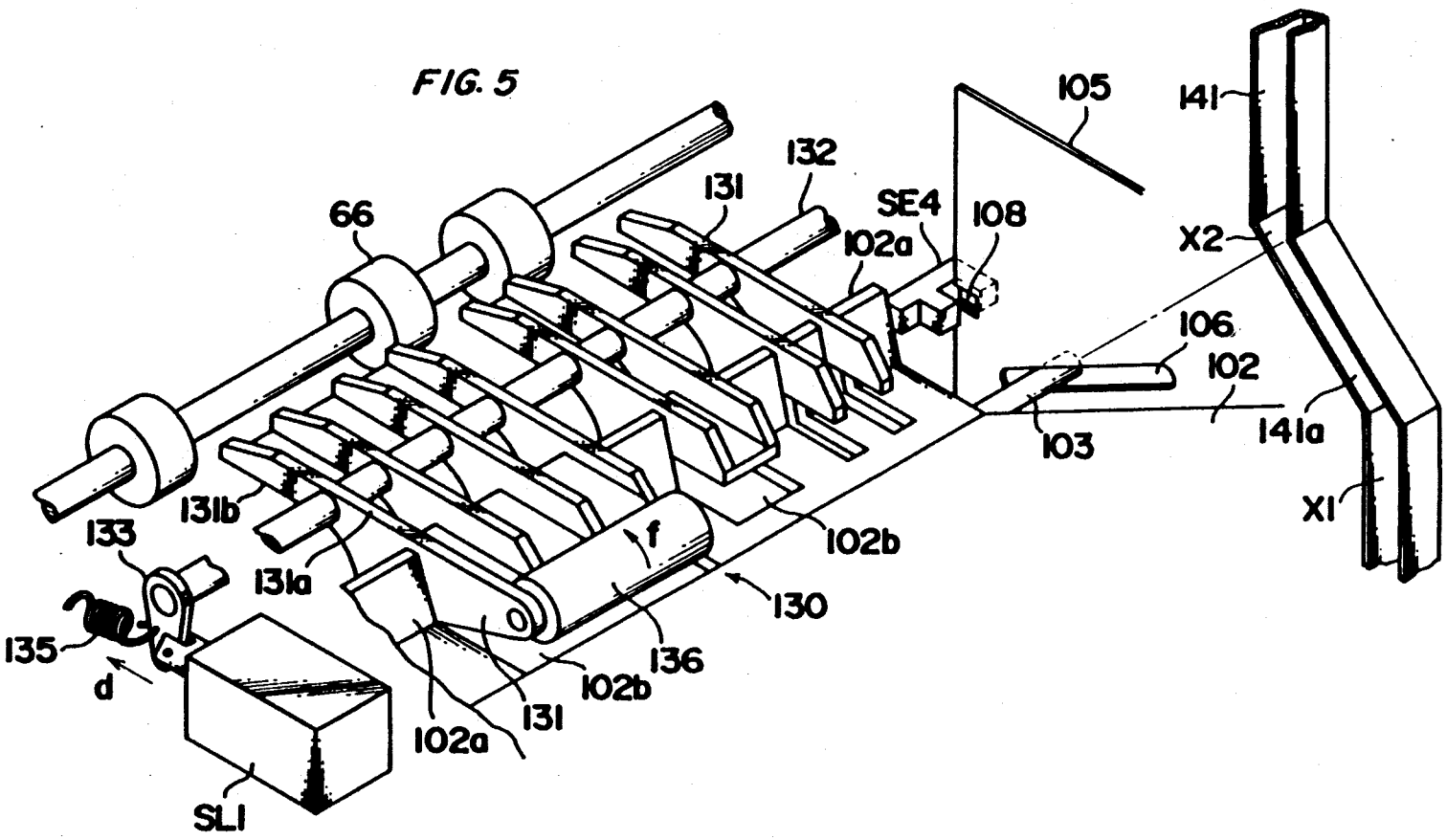
Figure 6:
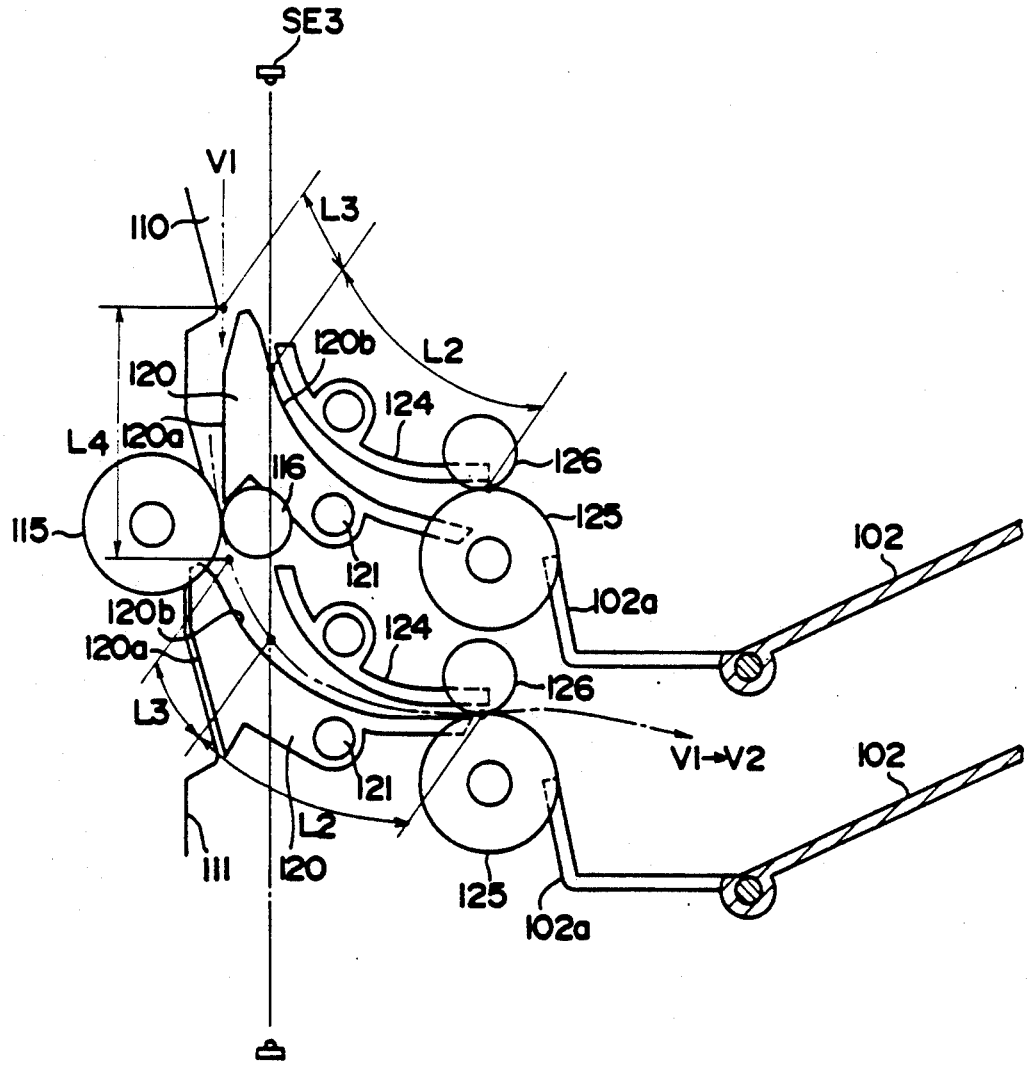
Figure 7:
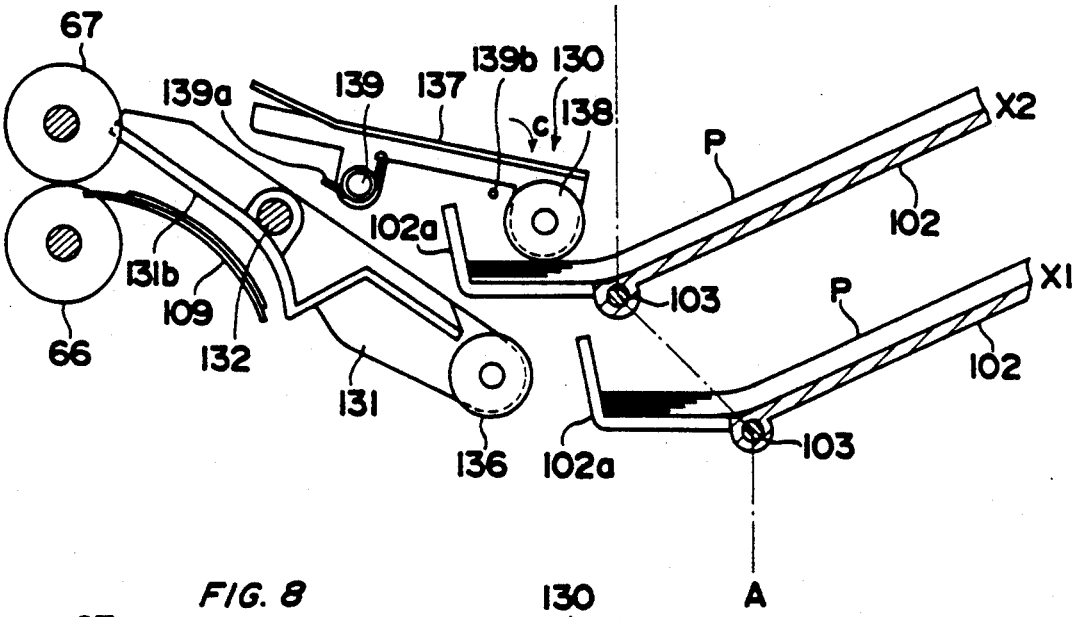
Figure 8:
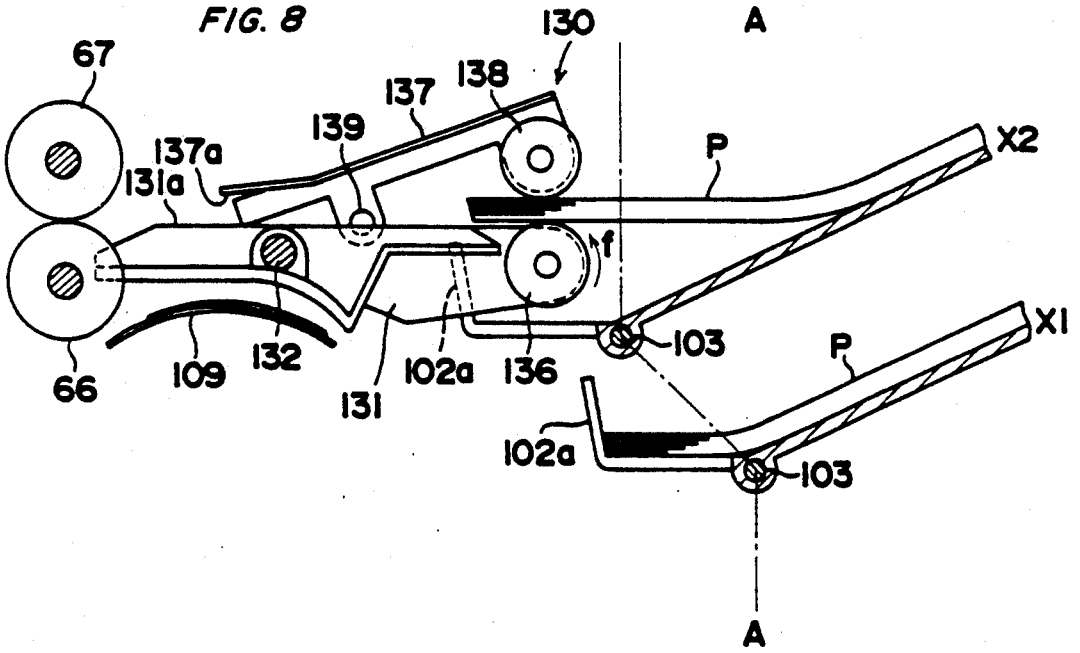
Figure 9:
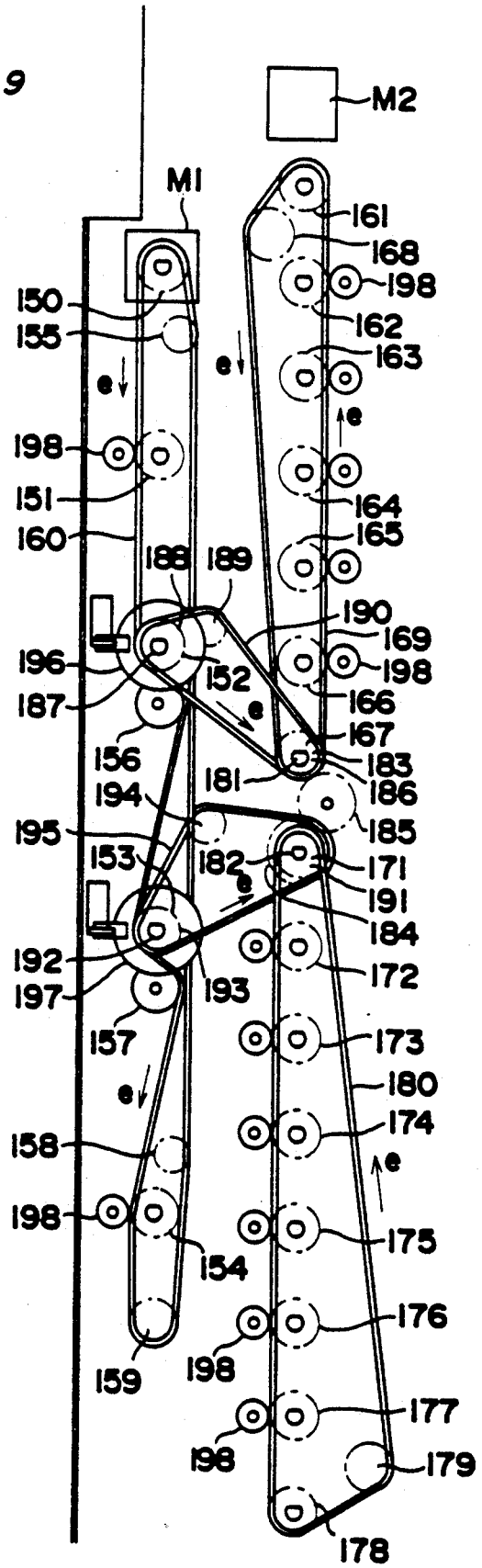
Figure 10:
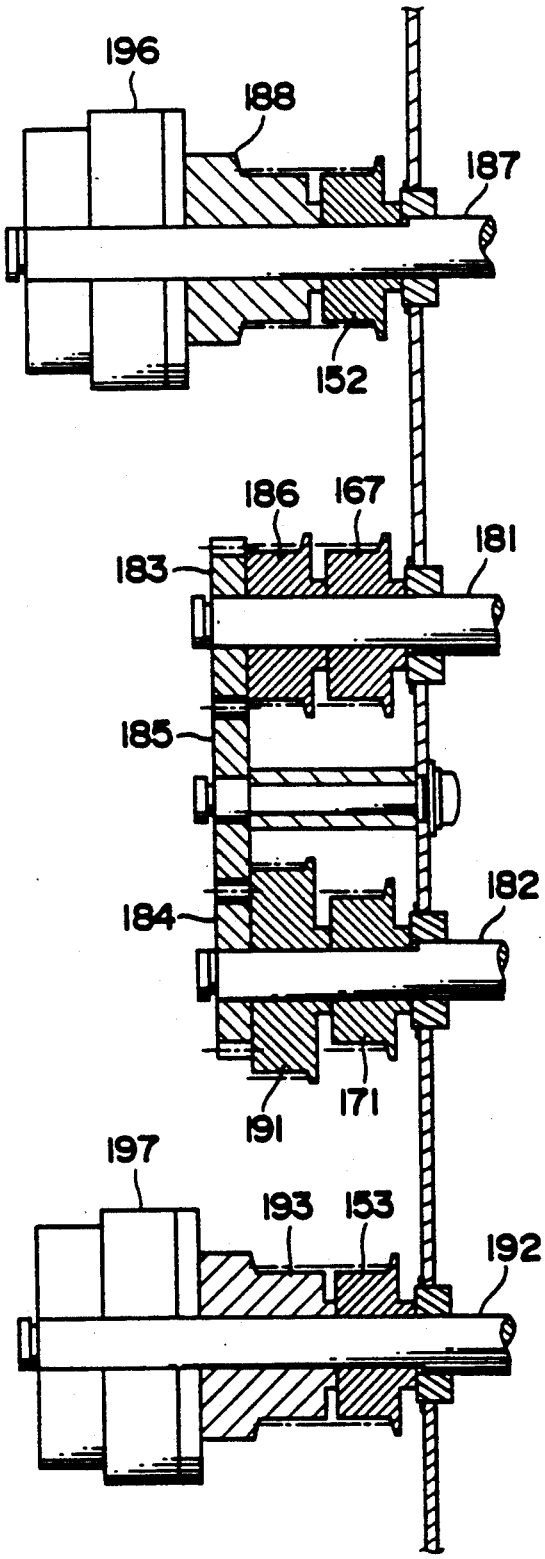
Figure 11:
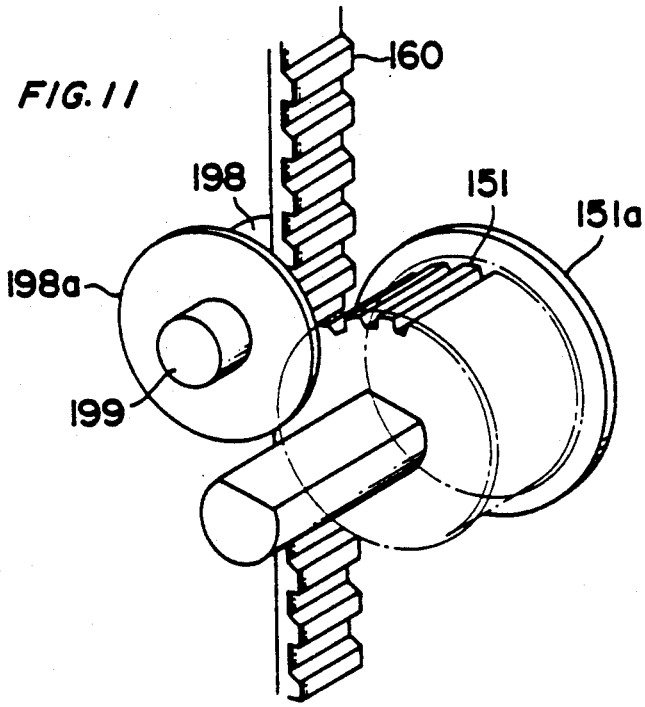
Figure 12:
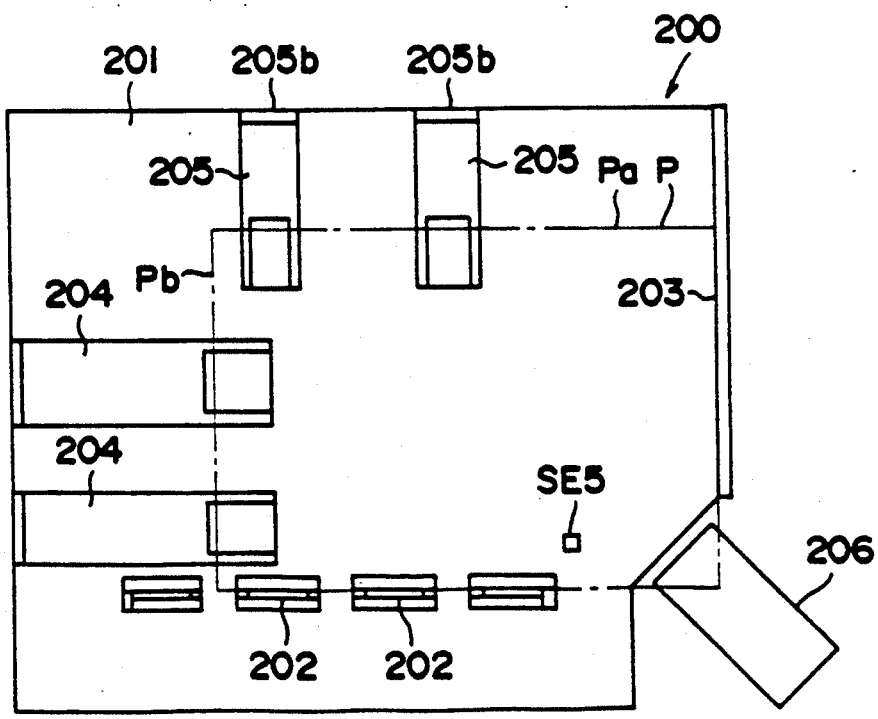
Figure 13:
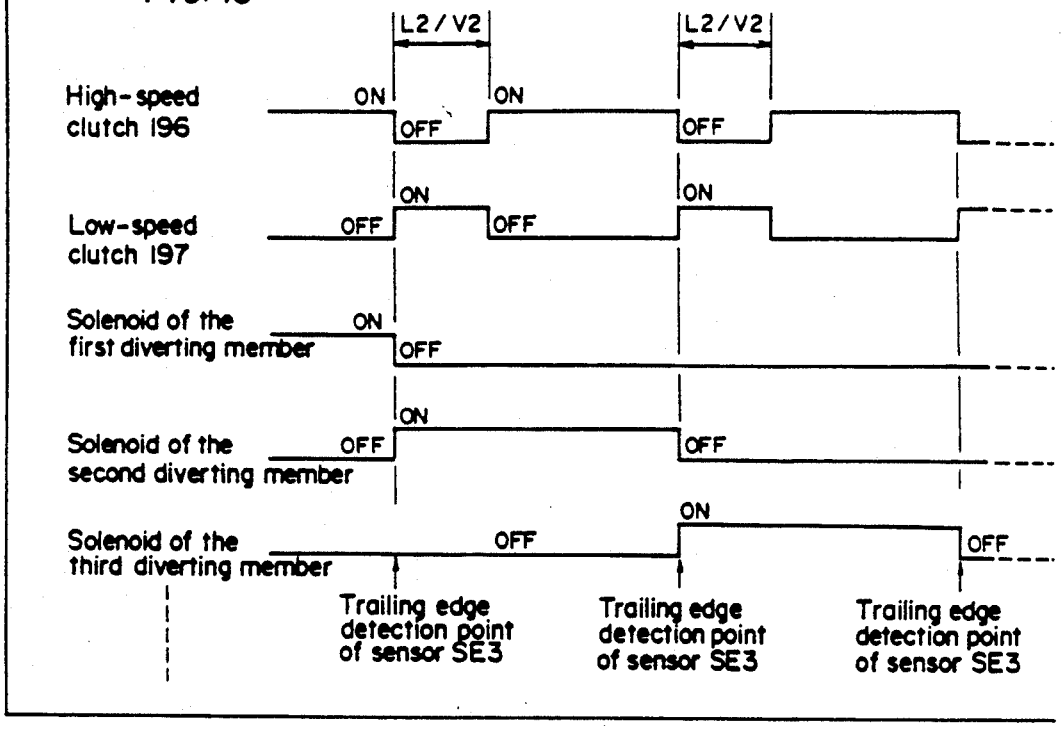
Figure 14:
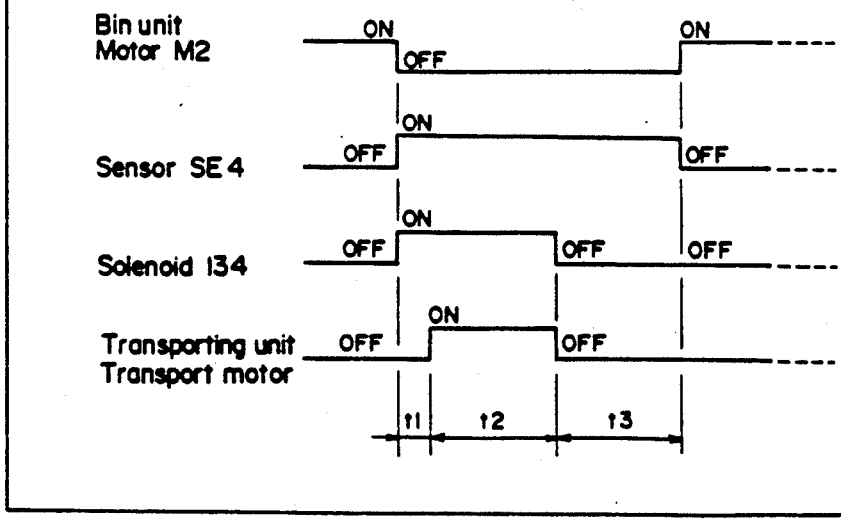
Figure 15:
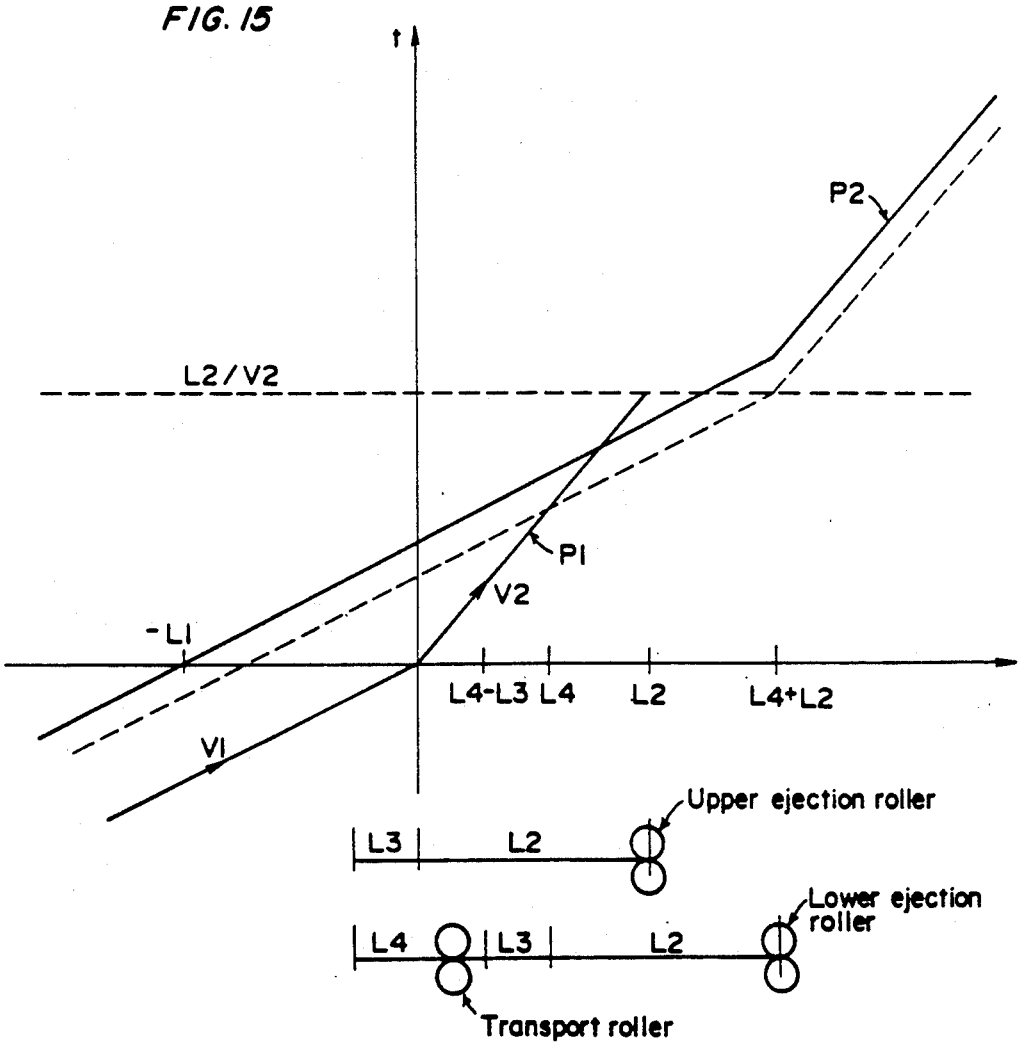
Figure 16:
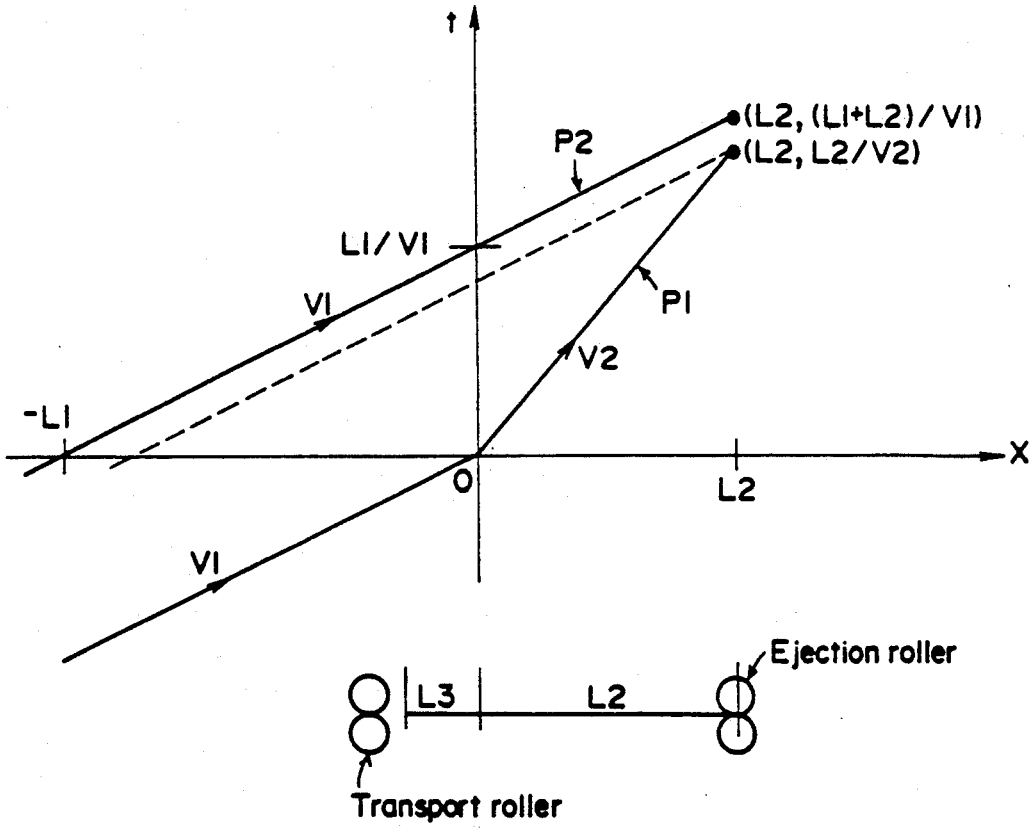
Figure 17:
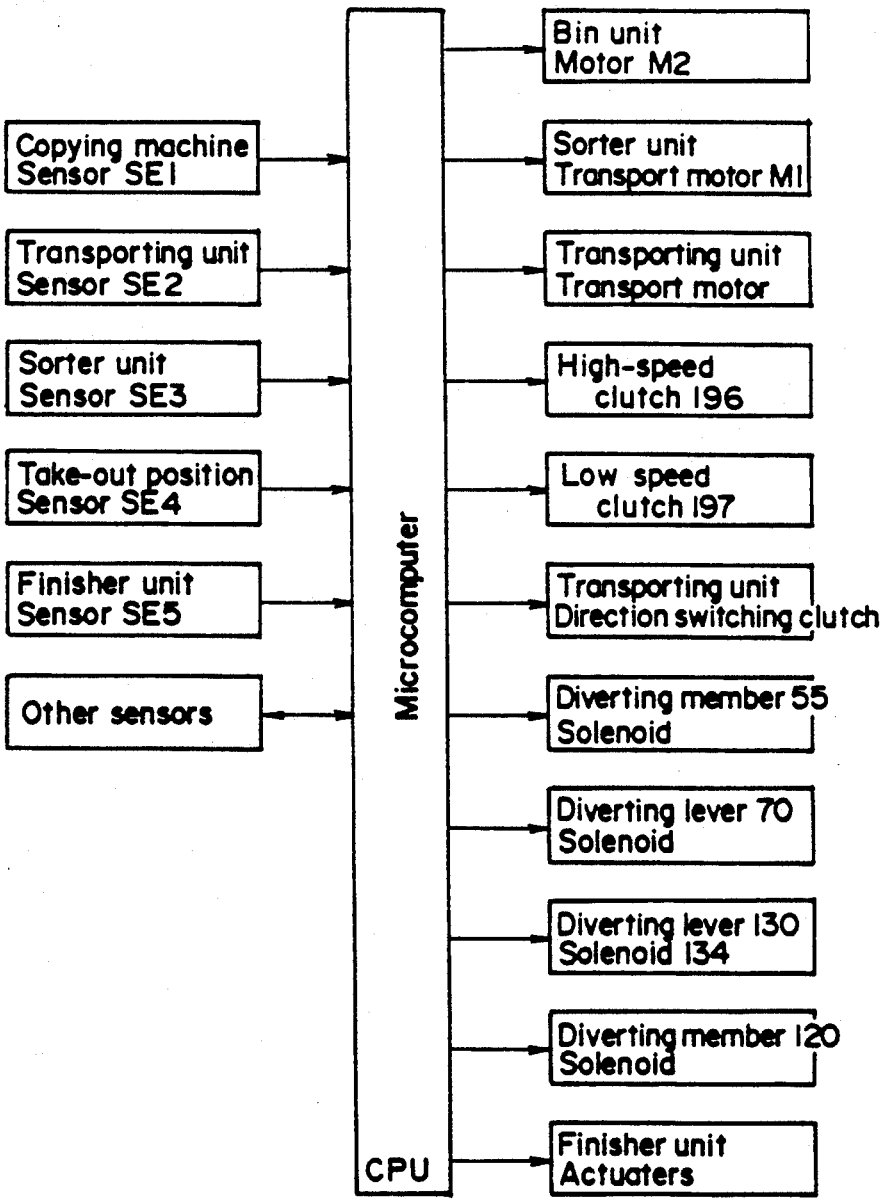

FIGS. *2a* and *2b* are views of the sorter-finisher showing the internal constitution;

FIGS. 3 and 4 are explanatory view of drive rollers in a paper transporting unit, showing a state that paper is passing through the rollers;

FIG. 5 is a perspective view of a paper take-out unit;

FIG. 6 is an explanatory view of diverting members for distribution sheets among bins;

FIGS. 7 and 8 are explanatory views of the operation of the take-out unit;

FIG. 9 is an explanatory view of a sorter unit showing the drive system;

FIG. 10 is a cross sectional view of the principal part of the drive system shown in FIG. 9;

FIG. 11 is a perspective view of the principal part of the drive system shown in FIG. 9;

FIG. 12 is a front view of a stapling tray;

FIG. 13 is a timing chart showing a control of the sorter unit:

FIG. 14 is a timing chart showing the paper take-out operation;

FIGS. 15 and 16 are graphs explaining the relation between the travel speed of sheets and the control of the diverting members in a sorting mode and in a groupoing mode respectively;

FIG. 17 is a block diagram of a control circuitry ; and

Figure 18:
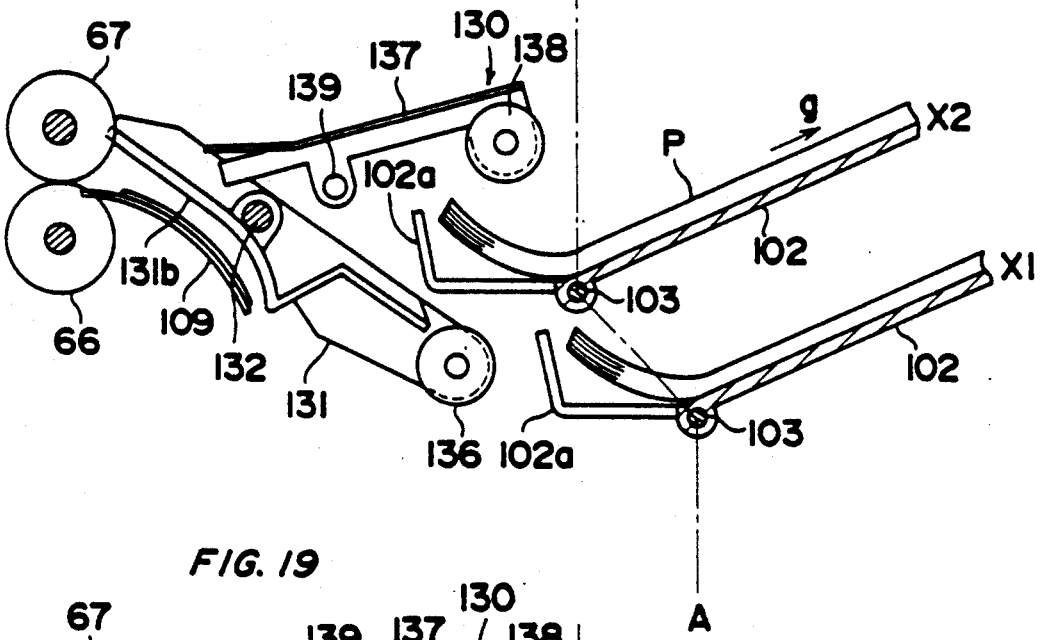
Figure 19:
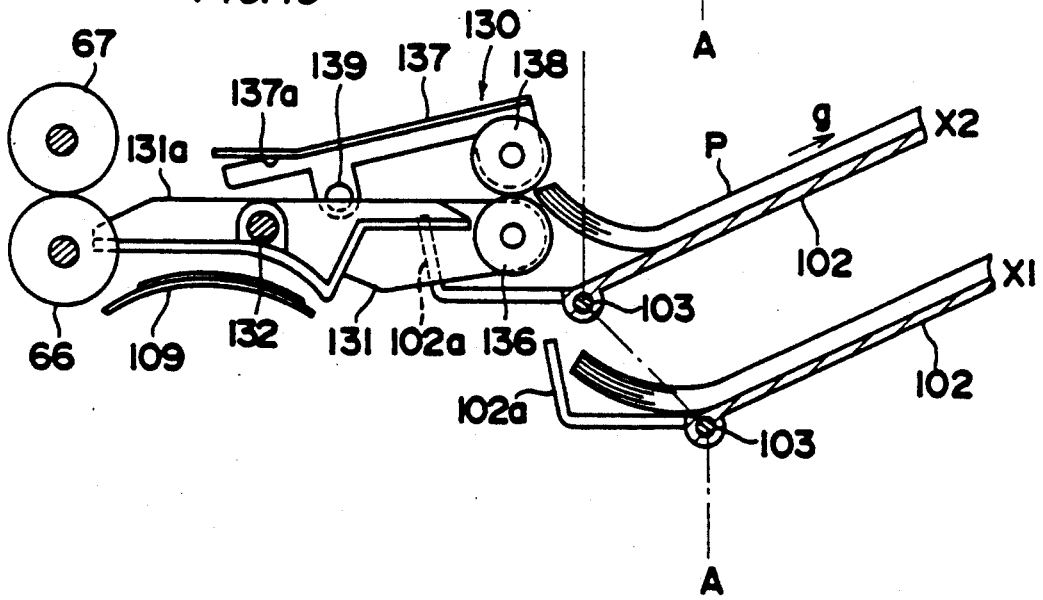

FIGS. 18 and 19 are views showing an example of undesirable operation of the paper take-out unit.

DETAILED DESCRIPTION OF THE PREFERRED EMBODIMENTS

A sorter-finisher as an embodiment according to the present invention is hereinafter described in reference to the accompanying drawings.

General Constitution

Figure 1:
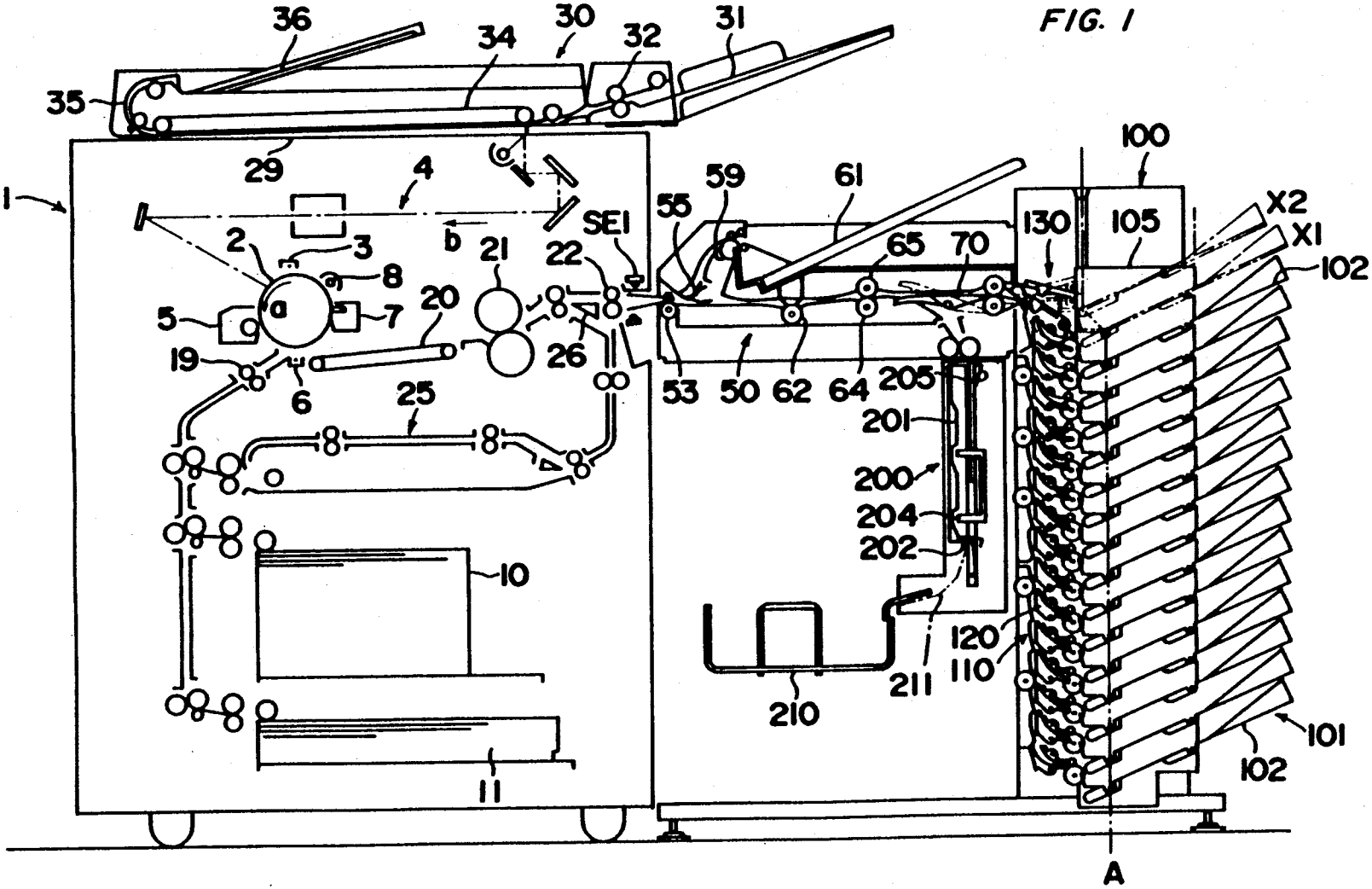
FIGS. 1 through 17 show a sorter-finisher as an embodiment according to the present invention.

A sorter unit 100, as shown in FIG.1, is mounted on a side of a copying machine 1 through a paper transporting unit 50, and under the paper transporting unit 50, a finisher unit 200 wherein stapling operation is executed is installed. The copying machine 1 is provided with an automatic document feeder 30 (which is hereinafter referred to ADF).

The copying machine 1 functions to form an image on a paper sheet in conventional electrophotographic processing. A photosensitive drum 2 which is driven to rotate in the direction of the arror (a) is charged with specified potential by a charging device 3. Anoptical system 4 is moved in the direction of the arror (b), so that an original which was placed on an original glass 29 by the ADF 30 is exposed to light, thereby resulting in an electrostatic latent image on the photosensitive drum 2. The latent image is developed into a toner image by a developing device 5 taking a magenetic brush way, and the toner image is transferred onto a paper sheet by a transfer device 6.

Copying paper is fed sheet by sheet selectively from an elevate type 10 or a cassette type 11 of automatic feeding device, and a sheet fed therefrom is transported to the transfer section by a pair of timing rollers 19 at at specified timing. The sheet onto which a toner image has been transferred is fed to a fixing device 21 so that the image can be fixed on the sheet. Thereafter, the sheet is fed into the paper transporting section 50 through a pair of ejection rollers 22, and in this moment, a photosensor SE1 detects the sheet. Also, the copying machine 1 incorporates a refeeding section 25 which is used in duplex copying operation and composite copying operation, and a diverting member 26 for diverting the travel of paper is disposed before the pair of ejection rollers 22.

The photosensitive drum 2 continues rotating in the direction of the arrow (a) even after a toner image is transferred onto a sheet, so that residual toner and residual charge are removed therefrom by a cleaning device 7 with a blade and by an eraser lamp 8 respectively. Thus, the photosensitive drum 2 gets ready for the next copying operation.

The ADF 30 is a conventional one, which feeds originals one by one from an original tray 31 by a pair of feeding rollers 32 and positions an original on the original glass 29 by a conveyer belt 34. After the exposure of the original, the original is ejected onto a tray 36 through an original turn-over path 35 by the rotation of the conveyer belt 34.

Constitution and Operation of the Paper Transporting Unit

The paper transporting unit 50, as shown in FIG. *2a*, comprises guide plates 51 and 52 for receiving sheets ejected from the copying machine 1, a driving roller 53 and a following pinch roller 54, a diverting member 55, a non-sort tray 61, a diverting lever 70 and a transport route formed of a roller 62, a guide plate 72, etc.

The diverting member 55 can be driven by a solenoid to pivot on a shaft 56. When this solenoid is off, the diverting member 55 is kept at the position shown by the dashed line in FIG. 2*a* to guide paper sheets to the non-sort tray 61. In this case, sheets are guided by the upper surface of the diverting member 55 and guide plates 57 and 58 to an ejection roller 59 and a following pinch roller 60 and then transported to the non-sort tray 61. On the other hand, when a sorting mode or a grouping mode is selected, the solenoid is turned on, thereby setting the diverting member 55 at the position shown by the solid line in FIG. 2*a*. In this case, sheets are guided by the lower surface of the diverting member 55 toward the sorter unit 100.

Figure 2A:
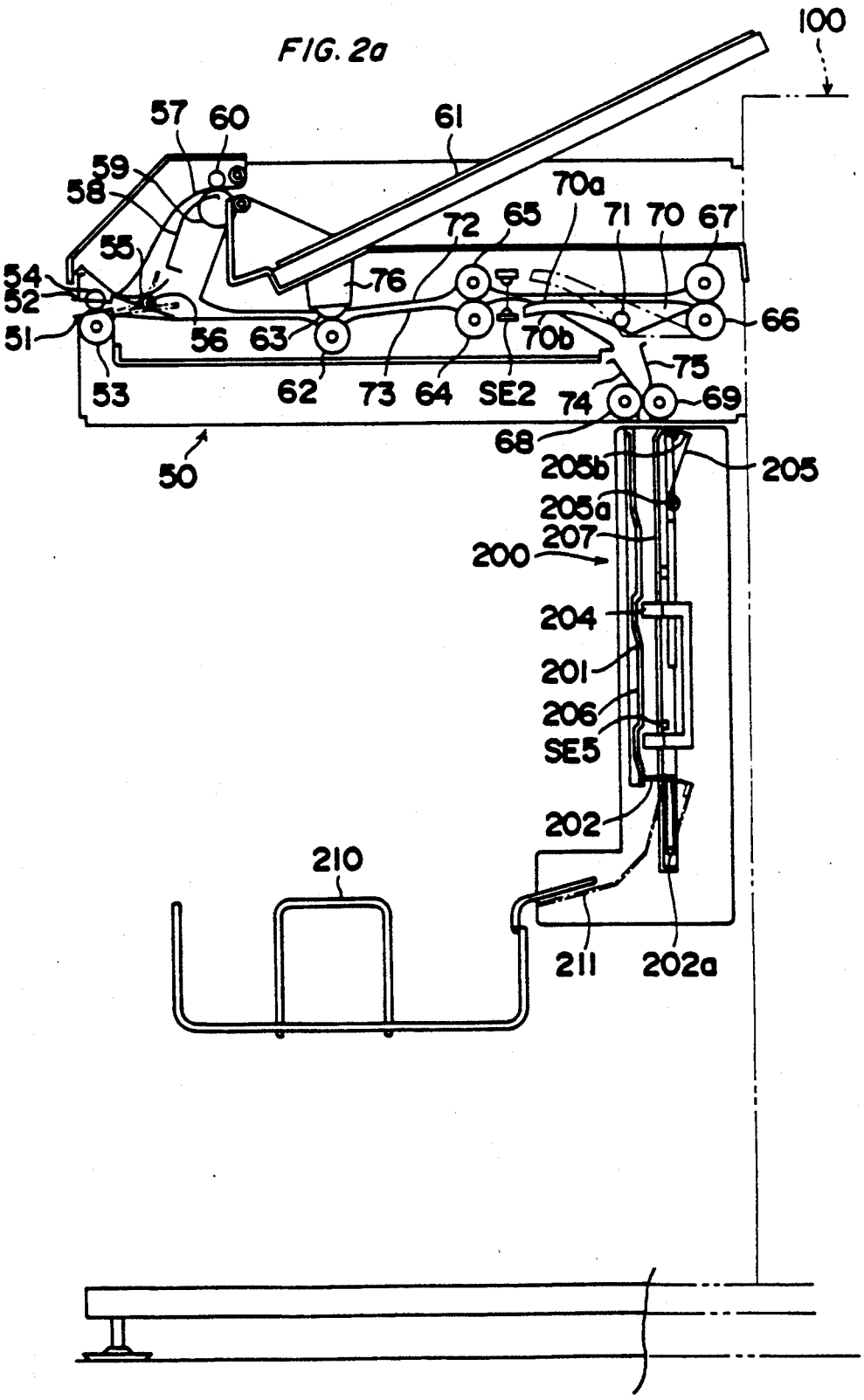
Figure 2B:
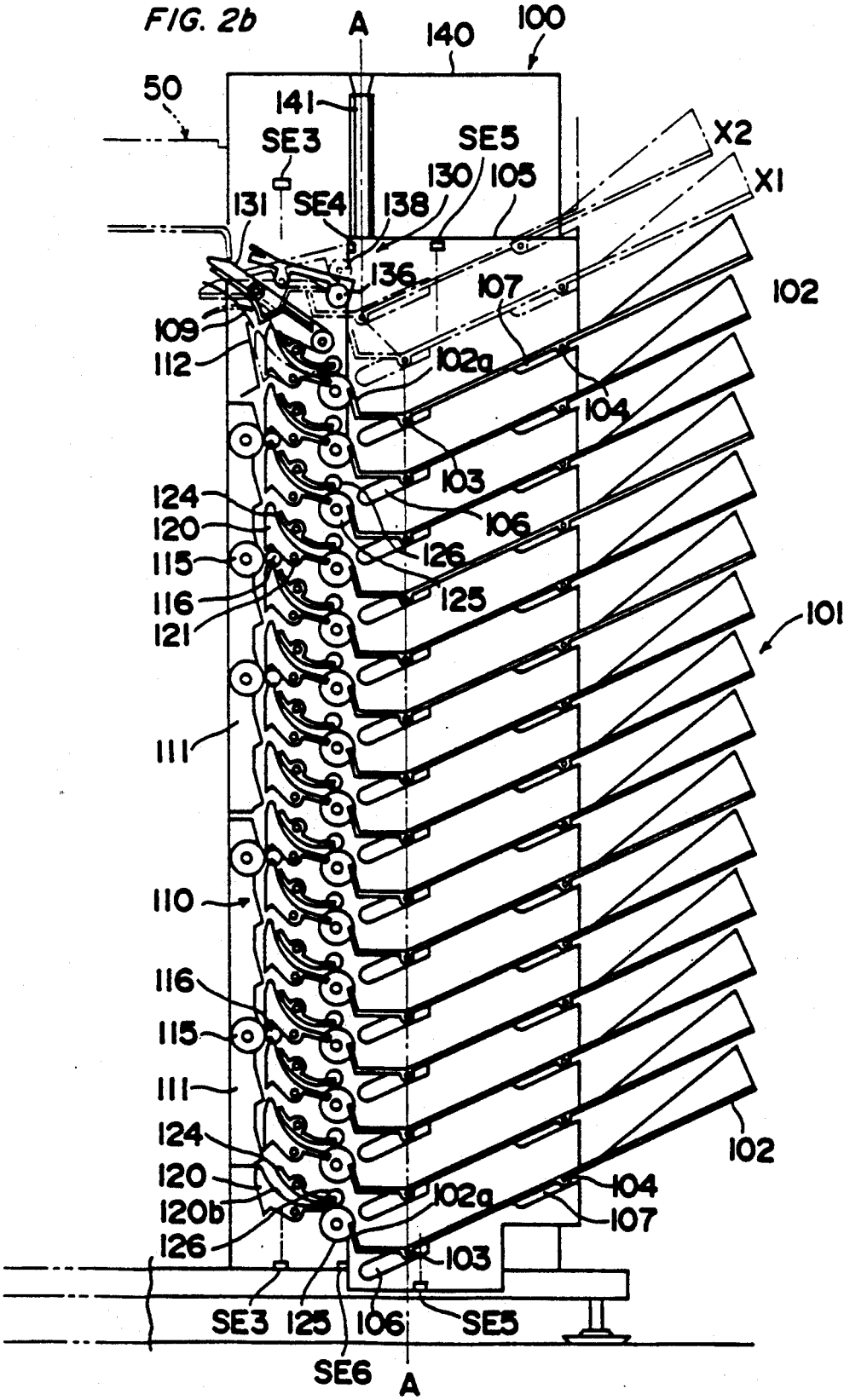

As shown in FIGS. 2*a* and 2*b*, the transport route through which sheets are transported to the sorter unit 100 and the finisher unit 200 comprises the diverting lever 70, the driving roller 62, a following ball 63 which is coupled with an in contact with the driving roller 62, driving rollers 64, 65, 66, 67, 68, 69, guide plates 72, 73, 74, and 75. A photosensor SE2 for detecting paper being transported is disposed immediately after the rollers 64 and 65. This transport route leads paper ejected from the copying machine 1 to the sorter unit 100 sheet by sheet, and it also, as described later, leads paper taken out from each bin 102 in the sorter unit 100 to the finisher unit 200. The diverting lever 70 can be driven by a solenoid to turn on a shaft 71, and when the solenoid is off, the diverting lever 70 is kept at the position shown by the solid line in FIG. 2*a*. In this moment, paper sheets are guided by the upper surface 70*a* of the diverting lever 70, the guide plates 72 and 73 and transported to the sorter unit 100.

The driving rollers 62 and 64 through 67 can be driven by a transport motor and switch their rotation in the forward and the reverse directions by means of a clutch. When sheets which were distributed and have been stored in each bin 102 are taken out therefrom, the rollers 62 and 64 through 67 are reversed to transport the sheets toward the left side in FIG. 2*a*. In this moment, the sheets are guided toward left by the upper surface 70*a* of the diverting lever 70, the guide plates 72 and 73. When the sensor SE2 detects the trailing edge of the sheets, the driving rollers 62, 64 and 65 are switched to forward rotation. At this same time, the solenoid is turned on to set the diverting lever 70 at the position shown by the dashed line in FIG. 2*a* so that the sheets can be guided by the lower surface 70*b* of the lever 70 and transported to the finisher unit 200 through the driving rollers 68 and 69.

Further, when a finisher mode is selected, sheets stacked on each bin 102 have to be transported to the finisher unit 200 in a bunch, but stacks of sheets vary in thickness according to the number of sheets. Accordingly, each of the rollers 62 through 69 have to be so constituted that any stack of sheets can be well transported without going into pieces regardless of the thickness of the stack.

Conventionally, such rollers have been made of an elastic material such as sponge, but this causes fluctuation of torque and deformation of the elastic material by means of the number of sheets.

Therefore, in this embodiment, the rollers are made of comparatively firm resign. Both rollers of a pair are driving rollers, and the distance between the rollers of a pair can be adjusted freely. That is, the following balls 63 are made of steel and so disposed on brackets 76, which are arranged on the reverse side of the non-sort tray 61, that the balls 63 are rotatable and movable up and down, and the balls 63 are in contact with the top of the driving rollers 62 by their own weight. As shown in FIGS. 3 and 4, the roller 64 is fixed, and the other roller 65 is movable toward and away from the roller 64 and is pressed against the roller 64 by a torsion spring 85. Specifically, the driving force is first transmitted to a gear 80 fixed on a shaft 64*a*, which is a supporting shaft of the lower roller 64, so that the roller 64 is rotated. The gear 80 is connected to a gear 83 fixed on a shaft 65*a*, which is supporting the upper roller 65, via gears 81 and 82, so that the driving force is transmitted to the gear 83 to rotate the driving roller 65. The gears 81 and 82 are disposed on shafts 81*a* and 82*a* respectively, and the roller 65 is supported by an arm 84 which is capable of turning on the shaft 82*a*. When the arm 84 is urged counterclockwise in FIG. 3 by the torsion spring 85, the roller 65 comes into contact with the roller 64. Accordingly, when paper P has only one sheet or a few sheets, the paper P passes between the rollers 64 and 65 in a state as shown in FIG. 3. When paper P has a number of sheets, as shown in FIG. 4, the roller 65 is moved upward together with the arm 84 in accordance with the thickness of the paper P resisting the elasticity of the torsion spring 84, and thus the paper P passes between the rollers 64 and 65. That is, the elasticity of the torsion spring 85 is not too strong to prevent the arm 84 from turning clockwise when a number of sheets come to the rollers 64 and 65. Accordingly, when feeding a number of sheets, the space between the rollers 64 and 65 is adjusted to the thickness of the sheets, and the rollers 64 and 65 provide the sheets with transporting force on both of the upper surface and the lower surface of the sheets. Thus, the sheets can be well transported without any skew.

Further, although the constitution and the operation of the other rollers 66, 67, 68 and 69 are not shown in the drawings, they are the same as those of the rollers 64 and 65 as shown in FIGS. 3 and 4.

Constitution and Operation of the Sorter Unit

The sorter unit 100, as shown in FIG. 2*b*, comprises a bin unit 101 including 15 bins 102 among which sheets are distributed, a vertical path 110, diverting members 120, ejection rollers 125, 126, a paper take-out unit 130 and a device for moving the bin unit 101. Each diverting member 120 and each pair of ejection rollers 125 and 126 are disposed before each bin 102 in a set.

A plurality of diverting levers 131 and a guide plate 109 which also function as the paper take-out unit 130 make up a paper receiving portion. As shown in FIGS. 5 and 7, the diverting levers 131 are fixed on a shaft 132, and the shaft 132 is connected to a solenoid 134 via a lever 133 at the end and is urged in the direction of the arrow (d) by a coil spring 135. When the solenoid 134 is off, the diverting levers 131 are set at the position shown in the solid lines in FIGS. 2*b* and 7. In this moment, sheets are guided by the lower surfaces 131*b* of the diverting levers 131 and the guide plate 109 and fed into the vertical path 110.

The vertical path 110, as shown in FIG. 2*b*, comprises a guide frame 111, a guide plate 112, five transport rollers 115, pinch rollers 116 which are coupled with the transport rollers 115 and rotates following the rotation of the transport rollers 115, the diverting members 120, guide plates 124, the pairs of ejection roller 125 and pinch roller 126. Each pinch roller 126 rotates followng the rotation of the corresponding each ejection roller 125, and each diverting member 120, each guide plate 124 and each pair of ejection roller 125 and pinch roller 126 are arranged before each bin 102 in a set. Also, as shown in FIG. 6, a photosensor SE3 for detecting a sheet which is about to enter the bin 102 is disposed before each of the bins 102.

All of the diverting members 120 can be driven by respective solenoids to turn on respective shafts 121, excepting the one which is provided for the bottom bin. When the solenoid is off, the corresponding diverting member 120 is kept at the position shown by the solid line in FIG. 2*b*, so that sheets are guided downward by the vertical surface 120*a* of the diverting member 120 and the vertical guide frame 111. The rollers 115 and 116 provide sheets with vertical transporting force. On the other hand, when each solenoid is turned on, the corresponding diverting member 120 is set at the position as shown by the dashed line before the top bin in FIG. 2*b* or is set into the state as shown by the lower part in FIG. 6. In this state, sheets are guided by the curved surface 120*b* of the diverting member 120 and the corresponding guide plate 124 and enter the bin 102 through the rollers 125 and 126. The timing of the motion of the diverting members 120 depends on the timing at which the sensor SE3 detects the trailing edge of a sheet, and starting with the top bin, sheets are orderly distributed among the bins 102 according to the number of copy sets. Further, when a grouping mode is selected, copies of one original should be stored in the same bin, so that the diverting members 120 are moved in response to the completion of copying operation of one original. Additionally, the diverting member 120 for the bottom bin is fixed so that the curved surface 120*b* of the diverting member 120 can guide sheets into the bottom bin at all times.

Incidentally, as copying operation becomes speedy, the travel speed of sheets in the sorter unit 100 increases. If a sheet enters one of the bins 102 through the ejection rollers 125 and 126 keeping the speed high, the sheet may jump on the bin 102 or may push and skew sheets which have been stored in the bin 102, thereby resulting in disorder of sheets in the bin 102.

Therefore, in this embodiment, immediately before the trailing edge of a sheet goes out of the rollers 125 and 126, the rotating speed of the rollers 125 and 126 is reduced so that the sheet can slow down. However, if the rotating speed of the transport rollers 115 and 116 as well as the ejection rollers 125 and 126 is reduced, intervals among sheets being ejected from the copying machine 1 will be narrower, and the timing of diverting the flow of sheets by means of the diverting member 120 will be difficult, therefore causing a paper jam. Therefore, in this embodiment, only the rotating speed of the ejection rollers 125 and 126 is reduced when the sensor SE3 detects the trailing edge of a sheet.

The process of the above-mentioned slowdown is hereinafter described.

First, a drive system of the sorter unit 100 is described referring to FIGS. 9 and 10.

Referring to FIG. 9, driving pulleys 150 through 154 are to drive the transport rollers 115 and 116, and each of the pulleys 150 through 154 is disposed on the same shaft as each of the transport rollers 115 is. A timing belt 160 is wound around the driving pulleys 150 through 154 and tension pulleys 155 through 159. The driving force of a transport motor M1 is first transmitted to the driving pulley 150, and the timing belt 160 is rotated in the direction of the arrow (e). Also, driving pulleys 161 through 167 are to drive the ejection rollers 125 and 126 which are provided for the bins 102 from the first to the seventh, and each of the driving pulleys 161 through 167 is fixed to the same shaft as each of the rollers 125 is. A timing belt 169 is wound around the driving pulleys 161 through 167 and a tension pulley 168. Driving pulleys 171 through 178 are to drive the ejection rollers 125 and 126 which are provided for the bins 102 from the eighth to the fifteenth, and each of the driving pulleys 171 through 178 is fixed to the same shaft as each of the rollers 125 is. A timing belt 180 is wound around the driving pulleys 171 through 178 and a tension pulley 179.

A gear 183 is fastened to the shaft 181 which is supporting the driving pulley 167 provided for the seventh bin, and a gear 184 is fastened to the shaft 182 which is supporting the driving pulley 171 provided for the eighth bin. These gears 183 and 184 are connected to each other through an idle gear 185. A pulley 186 is fastened to the shaft 181, and a pulley 188 is fastened to the shaft 187 which is supporting the driving pulley 152. These pulleys 186, 188 and a tension pulley 189 are wounded with a timing belt 190. A pulley 191 is fixed on the shaft 182, and a pulley 193 is fixed on the shaft 192 which is supporting the driving pulley 153. These pulleys 191, 193 and a tension pulley 194 are wounded with a timing belt 195 likewise. The pulleys 188 and 193 are controlled by a high-speed clutch 196 and a low-speed clutch 197 respectively, which are disposed at the ends of the shafts 187 and 192 respectively. When the clutches 196 and 197 are off, the pulleys 188 and 193 freely turn on the shafts 187 and 192 respectively. When the clutches 196 and 197 are turned on, the pulleys 188 and 193 turn together with the shaft 187 and 192 respectively. The pulleys 188 and 186 have the same number of teeth, and the pulley 191 has one more teeth than the pulley 193 so that the slowdown can be accomplished.

In the above-described constitution, the high-speed clutch 196 is usually on, and the low-speed clutch 197 is usually off. First, the timing belt 160 is driven to rotate in the direction of the arrow (e) by the transport motor M1, thereby driving the transport rollers 115 to rotate. This rotation of the timing belt 160 is transmitted to the timing belt 190 through the pulley 188 driven by the high-speed clutch 196 which is on, and the timing belt 169 is driven to rotate in the direction of the arrow (e) through the pulley 186. At the same time, this rotating force is transmitted to the gear 184 and the driving pulley 171 through the gear 183 and the idle gear 185, and the timing belt 180 is rotated in the direction of the arrow (e). Thereby, the ejection rollers 125 are driven to rotate. In this moment, the ejection rollers 125 rotate as fast as the transport rollers 115 since the pulleys 188 and 186 have the same number of teeth.

When the sensor SE3 detects the trailing edge of a sheet going into the bin 102, the high-speed clutch 196 is turned off, and the low-speed clutch 197 is turned on. In this moment, the timing belt 160 driving the transport rollers 115 continues rotating in the direction of the arrow (e), so that the rotating speed of the transport rollers 115 does not change. Next, the description is given focusing on the timing belt 169 and 180 which drive the ejection rollers 125. The timing belt 195 is driven to rotate in the direction of the arrow (e) by the low-speed clutch 197 via the pulley 193. At the same time, this rotating force is transmitted to the gear 183 and the driving pulley 167 through the gear 184 and the idle gear 185, whereby the timing belt 169 is rotated in the direction of the arrow (e). In this moment, the rotating speed of the ejection rollers 125 is reduced since the pulley 191 has one more tooth than the pulley 193.

The rotating speed of the ejection rollers 125 and 126 which have been reduced is gained back to the same high speed before the trailing edge of the sheet passes through the nipping portion of the rollers 125 and 126. The clutches 196, 197 and the diverting members 120 are turned on and off at the timing as shown by a time chart in FIG. 13.

Further, in this embodiment, the driving pulleys 151 and 154, 162 through 166 and 172 through 177 engage with the timing belts 160, 169 and 180 along the tangents respectively, and one tooth of each pulley connects the pulley to each belt. In such a case, the timing belts may get out of place, causing a failure in transmission of the rotating force. Therefore, in this embodiment, a pressing roller 198 is coupled with each of the driving pulleys 151, 154, 162 through 166 and 172 through 177, and the rollers 198 are so arranged that the timing belts 160, 169 and 180 are stuck in the couples of pressing roller and driving pulley. The pressing roller 198, as shown in FIG. 11, has flanges 198*a* and rotates on a shaft 199 freely. The pressing roller 198 presses the timing belt 160 at the back against the driving pulley 151 in order to prevent the timing belt 160 from getting away from the driving pulley 151. Also, flanges 151*a* of the driving pulley 151 and the flanges 198*a* of the pressing roller 198 function to prevent the timing belt 160 from going aside.

Conditions of a change of the travel speed of sheets by the ejection rollers 125 and 126 are hereinafter described.

Suppose the travel speed of sheets to be V1 (which is corresponding to the copying speed and the feeding speed of the ejection rollers 125 and 126 when the high-speed clutch 196 is on), and the travel speed of sheets, when the low-speed clutch 197 is on, to be V2. Also, suppose intervals among traveling sheets to be L1, the distances between the point where the sensor SE3 detects a sheet and the nipping portion of the ejection rollers 125 and 126 to be L2, the distance between the detection point by the sensor SE3 and the diverging point of sheets by the diverting member 120 to be L3, and intervals among the diverging points to be L4.

When the sensor SE3 detects the trailing edge of a sheet being transported at a speed of V1, as already mentioned, the low-speed clutch 197 is turned on in order to reduce the speed from V1 to V2. Then, the sheet passes through the nipping portion of the ejection rollers 125 and 126. Accordingly, the time required for the sheet to be positioned in the bin 102 since the sheet passed through the sensor SE3 is L2/V2. The next sheet is traveling at a speed of V1, so that the feeding speed of ejection rollers 125 and 126 should be gained to the speed V1 before the time (L1+L2)/V1 elapses. Otherwise, the leading edge of the next sheet will come into the nipping portion of the ejection rollers 125 and 126 which are still driven to rotate at the low speed feeding sheets at a speed of V2, therefore causing a paper jam.

More specifically, the sheet distributing operation in a sorting mode is performed as shown in FIG. 15. In FIG. 15, the x-axis, the origin and the y-axis represent the paper path, the detection point by the sensor SE3, and time respectively. The line P1 shows the motion of the trailing edge of a sheet, and the line P2 shows the motion of the leading edge of the next sheet. The ejection rollers 125 and 126 are rotated at the low-speed to feed sheets at a speed of V2 during the time $0 \leqq t \leqq L2/V2$. If the leading edge of the next sheet reaches the nipping portion of the ejection rollers 125 and 126 during the time, the sheet will bend because of the speed difference (V1−V2), which may cause a paper jam. The distance between the trailing edge of a sheet and the leading edge of the next sheet is L1+L4+L2, and the latter sheet will catch up with the former sheet at the time (L1+L2+L4)/V1. Accordingly, the ejection rollers 125 and 126 should gain their feeding speed from V2 to V1 during $$L2/V2<(L1+L2+L4)/V1 \quad (1)$$

If the rotating speed of the ejection rollers 125 and 126 is gained back in the above condition, there will not be any fear of a paper jam and other troubles.

On the other hand, in a case of operation in a grouping mode, a succession of paper sheets is fed and stored in one bin 102, so that timing of changing the speed of the ejection rollers 125 and 126 is harder.

The sheet distributing operation in the grouping mode is shown in FIG. 16, and the X- and Y- axes and the marks represent the same as FIG. 15. In the grouping mode, the distance between the trailing edge of a sheet and the leading edge of the next sheet is L1+L2, and the latter sheet will catch up with the former sheet at the time (L1+L2)/V1. Accordingly, the feeding speed of the ejection rollers 125 and 126 should be changed from V2 to V1 during $$L2/V2<(L1+L2)/V1 \quad (2)$$

In this embodiment, the condition (2) is adopted in order to execute operation in the grouping mode as well as the sorting mode. However, in fact, the time lag between the time the high-speed clutch 196 is turned on and the time the feeding speed of the ejection rollers 125 and 126 reaches V1 needs to be taken into consideration.

Constitution and Operation of the Bin Unit

The bin unit 101 has 15 bins 102, and each bin is provided with a stopper 102*a* for preventing sheets from reversing and a notch 102*b*. As shown in FIGS. 2*b* and 5, shafts 103 and 104 disposed at both sides of each bin 102 engage with guide grooves 106 and 107 formed on a movable frame 105, so that the bins 102 can be held at regular vertical intervals. Also, the front shafts 103 protrude from the guide grooves 106 and engage with a guide groove 141 formed on a fixed frame 140.

The movable frame 105 is driven to move up and down by a bin unit motor M2 shown in FIG. 9. The guide groove 141 is bent at two points X1 and X2 (refer to FIG. 5) in the upper portion at an interval corresponding to the intervals among the bins. The points X2 is a paper take-out position, and X1 corresponds to the position where the bins 102 start sliding toward the paper take-out position X2. While sheets are distributed among the bins 102, the movable frame 105 and the bin unit 101 are in the lowest position as shown by the solid lines in FIG. 2*b*, and after the sorting operation, the bin unit 101 is moved upward. In this moment, each bin 102, whose locus is shown by the dashed line A in FIG. 2*b*, slides from the position X1 to the paper take-out position X2. The mechanism that the shafts 103 are guided by the inclination 141*a* of the guide groove 141 and that the shafts 103 and 104 are guided by the respective guide grooves 106 and 107 enables the bins 102 to thus slide. At the position X2, sheets in each bin 102 are taken out thereof by the paper take-out unit 130, which will be described later.

A photosensor SE4 is installed at the sheet take-out position X2, and the notches 108 provided for the movable frame 105 are so arranged that the light of the sensor SE4 penetrates through each notch 108 when each bin 102 reaches the paper take-out position X2. Each time a bin 102 reaches the paper take-out position X2, the sensor SE4 detects the corresponding notch 108, and the rising of the bin unit 101 which has been driven by the motor M2 is discontinued for a specified time. During the time, sheets are taken out from the bin 102.

Constitution and Operation of the Paper Take-out Unit

As shown in FIGS. 5, 7 and 8, the paper take-out unit 130 comprises a take-out roller 136 disposed at the front end of the diverting levers 131 and another take-out roller 138 fastened to the front end of the lever 137 which is located right above the take-out roller 136. The take-out roller 136 can be driven to rotate in the direction of the arrow (f) by a transport motor in the paper transporting unit 50. The lever 137 is pivoted on a shaft 139 and urged in the direction of the arrow (c) by a torsion spring 139*a*. The edge of the torsion spring 139*a* is fixed on the lever 137, and the other edge is fixed on the vertical guide frame 111. Further, a pin, 139*b* is provided as a stopper to stop the lever 137 from turning. The diverting levers 131, as already mentioned, can be turned on the shaft 132 by the solenoid 134, and when the solenoid 134 is off, they are kept at the position shown by the solid line in FIG. 7. While the diverting levers 131 keep the position, sheets coming from the paper transporting unit 50 are fed to the sorter unit 100, guided by the lower surfaces 131*b* of the diverting levers 131 and the guide plate 109.

In the above-described constitution, the motor M2 is turned on to move up the bin unit 101. Thereafter, when the notch 108 is detected by the sensor SE4, that is, when one of the bins 102 reaches the paper take-out position X2, the motor M2 is turned off, and the solenoid 134 is turned on. Immediately before that, the upper surface of the end portion of paper P stored in the bin 102 comes into contact with the upper take-out roller 138, and the take-out roller 138 slightly rises together with the lever 137 (refer to FIG. 7). Thereafter, the solenoid 134 is turned on, and thereby the diverting levers 131 is turned upward. Also, the lower take-out roller 136 comes into contact with the lower surface of the paper P through the notch 102*b* formed on the bin 102. Thus, the end portion of the paper P is nipped between the take-out rollers 136 and 138. The take-out roller 136 continues moving upward until the solenoid finishes its operation during the time t1: refer to FIG. 14), and the end portion of the paper P is raised beyond the stopper 102*a* of the bin 102, nipped between the take-out rollers 136 and 138 (refer to FIG. 8). When the time t1 elapses, the transport motor in the transporting unit 50 starts running to rotate the take-out rollers 136, 138 the driving rollers 62 and 64 through 69, and the paper P is fed to the transporting unit 50, guided by the upper surface 131*a* of the diverting levers 131 and the guide portion 137*a* of the lever 137.

Paper is transported as described above in order to be subjected to stapling operation. The paper P is fed back to the neighborhood of the driving rollers 62, 64 and 65. When the sensor SE2 detects the trailing edge of the paper P, the diverting lever 70 is set at the position shown by the dashed line in FIG. 2. At the same time, the driving rollers 62, 64 and 65 are started rotating in the reverse direction so that the paper P can reverse through the driving rollers 68 and 69. thus, the paper P is fed to the finisher unit 200.

In FIG. 14, the time t2 is the time required for the paper P to enter the finisher unit 200 since the paper P was taken out from the bin 102, and the time t3 is the time required for the stapling operation in the finisher unit 200. These times t1, t2 and t3 are counted by timers which are controlled by a microcomputer, and when the time t3 elapses, the bin unit motor M2 is turned on again to repeat the paper take-out operation.

In the paper take-out unit 130 as constituted above, the upper take-out roller 138 is set at the take-out position X2 beforehand. Immediately before the bin 102 reaches the take-out position X2, the upper surface of the paper P comes into contact with the roller 138. Then, keeping in contact with the upper surface of the paper P, the take-out roller 138 is moved upward following the rising of the bin 102. The lower take-out roller 136 comes into contact with the lower surface of the paper P after the upper take-out roller 138 comes into contact with the upper surface of the paper P. This arrangement enables the take-out rollers 136 and 138 to nip the paper P appropriately even if the end portion of the paper P is curled up, since the roller 138 presses down the upper surface of the paper P first.

If the take-out rollers 136 and 138 turn up and down simultaneously to nip the end portion of the paper P which is curled up, as shown in FIG. 18, the paper P may not be nipped but only pushed in the direction of the arrow (g) (refer to FIG. 19).

Constitution and Operation of the Finisher Unit

The finisher unit 200, as shown in FIGS. 2*a* and 12, comprises a stapling tray 201 which is vertically so disposed that its upper portion is open along with the driving rollers 68 and 69, a stopper 202 for closing and opening the bottom of the tray 201, a fixed regulation plate 203 for regulating the side of paper, a movable regulation plate 204 for regulating the other side of the paper, a top regulation plate 205 which covers and uncovers the tray 201 and is movable up and down and an electric stapler 206. Also, a photosensor SE5 is installed at the lower portion of the stapling tray 201, and further, a stack basket 210 is arranged under the tray 201.

Paper P is fed into the stapling tray 201 by the driving rollers 68 and 69 and falls freely until its edge reaches the stopper 202. Thus, the paper P is positioned in the tray 201. The top regulation plate 205 turns counterclockwise in FIG. 2*a* on a shaft 205*a* so that a regulation portion 205*b* of the plate 205 can move to the top of the tray 201. Then, the regulation portion 205*b* is moved down to the upper edge Pa of the paper P, so that the paper P can be vertically regulated by the regulation portion 205*b* and the stopper 202. Also, the regulation plate 204 is moved right in FIG. 2*a* and comes into contact with the left side Pb of the paper P in order to regulate the paper P laterally in cooperation with the fixed regulation plate 203.

When the alignment of the paper P is completed, the stapler 206 is driven to staple the paper P. Thereafter, the stopper 202 is slightly turned clockwise in FIG. 2*a* to open the bottom of the tray 201. Thereby, the paper P is guided by the guide plate 211 and ejected into the stack basket 210.

The paper take-out operation and the finishing operation described above are repeated the same number of times as set beforehand.

The above-described operation of the sorter is controlled by a microcomputer as shown in FIG. 17. Signals produced from the sensors SE1 through SE5 are sent to the microcomputer, and signals actuating the motors, clutches, solenoids, etc. are produced therefrom.

Other Embodiments

Although the paper take-out unit 130 is disposed at the upper portion of the bin unit 101 in the above-described embodiment, it can be disposed at the lower portion thereof. Also, in the embodiment, the paper transporting unit 50 is so constituted that paper taken out of each bin 102 passes above the finisher unit 200 once and then the paper reverses to the stapling tray 201, but the paper can be fed into the tray 201 directly.

The reduction of the rotating speed of the ejection rollers 125 and 126 for a specified time for the purpose of improving the alignment of sheets in the bin 102 can be controlled in response to not only a sheet detection signal produced from the sensor SE3 but also a timer. Such a speed control can be applied to any kind of paper ejection device which feeds paper sheets onto a tray by the rotation of a pair of rollers, besides a device for feeding sheets into a bin of a sorter unit.

In the embodiment above, in taking out paper of each bin 102, the take-out rollers 136 and 138 nip the paper and further lift the paper to get over the stopper 102*a*, but the stopper 102*a* can be so made that the stopper 102*a* is laid down during the paper take-out operation.

In the paper transporting unit 50, in order to cope with the thickness of paper, as shown in FIGS. 5 and 6, the rotating force is transmitted to the upper and lower rollers 64 and 65, and one of the rollers (65 in this case) is movable toward and away from the other roller (64) and urged by elasticity. This mechanism can be applied to other devices for transporting a number of sheets. As shown in FIG. 11, the pressing rollers 198 are arranged to prevent the timing belt 160 from getting away from the pulley 150. This mechanism can be applied to other devices as well as sorters, too.

Although the present invention has been described in connection with the preferred embodiments thereof, it is to be noted that various changes and modifications are apparent to those who are skilled in the art. Such changes and modifications are to be understood as included within the scope of the present invention as defined by the appended claims, unless they depart therefrom.

What is claimed is:

1. A sorter-finisher comprising:

a plurality of bins vertically arranged upon another, said bins being movable upwardly from a sheet receiving position;

distributing means for distributing sheets discharged from an image forming apparatus among said bins when said bins are in the sheet receiving positions;

take-out means for taking a bunch of sheets which has been stored in each bin out thereof, said take-out means being fixedly installed above the sheet receiving position of said bins;

drive means for raising said bins from the sheet receiving position after the completion of a sheet distributing operation so that each bin faces said take-out means; and stapling means for stapling the bunch of sheets taken out of each bin by said take-out means.

2. A sorter-finisher as claimed in claim 1, wherein said stapling means is installed below said take-out means.

3. A sorter-finisher as claimed in claim 1, wherein said take-out means includes a pair of rollers which presses up and down and nips the bunch of sheets in each bin.

4. A sorter-finisher comprising:

a plurality of bins vertically arranged one upon another, said bins being vertically movable;

distributing means for distributing sheets discharged from an image forming apparatus among said bins;

take-out means for taking a bunch of sheets which has been stored in each bin out thereof, said take-out means being installed over said distributing means;

first drive means for vertically moving said bins;

second drive means for laterally moving each bin brought to almost the same vertical position as said take-out means by said first drive means toward said take-out means; and stapling means for stapling the bunch of sheets taken out of each bin by said take-out means.

5. A sorter-finisher as claimed in claim 4, wherein said take-out means includes a pair of rollers which presses up and down and nips the bunch of sheets in each bin.

6. A sorter-finisher as claimed in claim 4, wherein said first drive means moves up and down all the bins in a body.

7. A sorter-finisher as claimed in claim 4, wherein said first and second drive means includes:

a side frame for supporting said bins, said bins being so mounted that each bin can move laterally;

guide means for helping said bins to move vertically and for guiding each bin brought to the neighborhood of said take-out means toward said take-out means; and a drive source for moving up and down said side frame.

8. A sorter-finisher comprising:

a plurality of bins vertically arranged one upon another;

distributing means for distributing sheets discharged from an image forming apparatus among said bins;

drive means for vertically moving said bins to a paper take-out position;

a first take-out roller, which is installed at the paper take-out position, coming into contact with a surface of a bunch of sheets stored in each bin immediately before the bin reaches the paper take-out position and moving following the movement of the bin, keeping in touch with the sheets;

a second take-out roller, which is capable of going into and getting out of the paper take-out position, after said first take-out roller came into contact with a surface of the bunch of sheets, coming into contact with the other surface of the bunch so as to nip the sheets in the bin in cooperation with said first take-out roller; and stapling means for stapling the bunch of sheets taken out of the bin by the first and second take-out rollers.

9. A sorter-finisher comprising:

a sorter unit equipped with a plurality of bins, wherein sheets are distributed among the bins and thereafter taken out of each bin;

a transporting unit for connecting a paper discharge portion of an image forming apparatus with a paper receiving/take-out portion of said sorter unit;

a finisher unit, which is installed below said paper transporting unit, for binding the bunch of sheets taken out of each bin; and diverting means for diverting the travel of paper in said transporting unit so as to lead sheets discharged from the image forming apparatus to said sorter unit and to lead sheets taken out of each bin to said finisher unit.

10. A sorter-finisher as claimed in claim 9, wherein said transporting unit includes a first transport section for leading sheets from the discharge portion of the image forming apparatus to said diverting means, a second transport section for leading sheets from said diverting means to said receiving/take-out portion and a third transport section for leading sheets from said diverting means to said finisher unit;

said diverting means has a first guide surface for guiding sheets from said first transport section to said second transport section and also from said second transport section to said first transport section, and a second guide surface for guiding sheets from said first transport section to said third transport section;

so that sheets discharged from the image forming apparatus are transported one by one, guided by said first guide surface of said diverting means from said first transport section to said second transport section to be distributed among said bins, and sheets taken out of each bin are transported section, guided by said first guide surface of said diverting means, and then the sheets are transported to said third transport section, guided by said second guide surface of said diverting means to be transported into said finisher unit.

* * * * *